US006003780A

United States Patent [19]

Gurries, II et al.

[11] Patent Number: 6,003,780

[45] Date of Patent: Dec. 21, 1999

[54] FREEZEPROOF VALVE ASSEMBLY FOR A DRINKING FOUNTAIN

[75] Inventors: Albert G. Gurries, II, Reno; Sam T. Hong, Sparks, both of Nev.

[73] Assignee: Haws Company, A Nevada Corporation, Sparks, Nev.

[21] Appl. No.: 09/139,800

[22] Filed: Aug. 25, 1998

[51] Int. Cl.[6] ..... B05B 12/14; E03B 9/02

[52] U.S. Cl. ..... 239/29; 137/281; 137/282; 137/301

[58] Field of Search ..... 239/29, 28, 24, 239/75, 119; 137/281, 282, 301, 302, 307, 308; 222/571

[56] References Cited

U.S. PATENT DOCUMENTS 4,096,877 6/1978 Arledge, II et al. ..... 137/281
4,653,521 3/1987 Fillman ..... 137/1

*Primary Examiner*—Henry J. Recla
*Assistant Examiner*—Peter deVore
*Attorney, Agent, or Firm*—Kelly Bauersfeld Lowry & Kelley, LLP

[57] ABSTRACT

An improved freezeproof or freeze resistant valve assembly is provided for use in an outdoor drinking fountain or the like. The fountain includes a main on-off valve for coupling an underground water supply conduit via a standpipe to a fountain head to dispense water. The freezeproof assembly comprises a sump chamber installed below the frost line and having a piston mounted therein for reciprocal movement between advanced and retracted positions. When the main valve is turned off, the piston retracts by gravity within the sump chamber and residual water remaining within the standpipe drains to the sump chamber at low pressure through a normally open control valve mounted on the piston. When the main valve is turned on, the control valve is closed by water pressure and the piston is advanced within the sump chamber to expel the water previously collected therein through a discharge conduit coupled to a main fountain drain.

20 Claims, 4 Drawing Sheets

FREEZEPROOF VALVE ASSEMBLY FOR A DRINKING FOUNTAIN

BACKGROUND OF THE INVENTION

This invention relates generally to freezeproof or freeze resistant valve assemblies for use in an outdoor drinking fountain or the like, to provide a reliable water supply particularly during cold weather conditions. More specifically, this invention relates to an improved freezeproof valve assembly designed for collecting residual water from fountain supply lines within an underground sump chamber where it is safeguarded against freezing, and for subsequently discharging the collected residual water to a main fountain drain.

Outdoor drinking fountains are generally known in the art and typically include a fountain or bubbler head mounted over a basin which is supported on a fountain pedestal at a selected height above the ground. A main on-off valve including a valve handle or actuator is normally mounted on or near the basin for convenient actuation to initiate water flow to the fountain head which produces a gentle stream projected upwardly over the basin for convenient drinking access. Excess water is collected within the basin and guided thereby to a main drain for flow to a suitable waste site, such as to a sewer line.

During cold winter weather conditions, outdoor drinking fountains have encountered freeze problems. More specifically, the fountain is typically coupled to a water supply line which is buried underground at a depth below the normal frost line to prevent water therein from freezing. However, the water supply line is connected to the fountain by a standpipe or the like which necessarily extends above the frost line and further above the ground to supply water to the fountain head. Water residing within the standpipe is exposed to freezing temperatures and thus may freeze therein to obstruct water flow and fountain usage, while additionally posing a significant risk of pipe breakage. In the past, this freeze problem has typically been addressed by draining the standpipe or the like and disabling the drinking fountain for the duration of the winter season.

More recently, freezeproof valve mechanisms have been developed for use in an outdoor drinking fountain or the like to permit continued fountain use during cold weather conditions without significant risk of pipe freeze-up or breakage. In such mechanisms, a valve actuator is typically provided on the fountain pedestal for operating the main on-off valve positioned remotely at an underground location below the frost line. When the main valve is turned on, water is allowed to flow upwardly through a standpipe to the fountain head for dispensing. However, when the main valve is turned off, residual water within the standpipe is drained away. In earlier designs, this residual water was discharged to the ground. In more current designs, this residual water has been drained to an underground collection chamber where it is temporarily stored below the frost line to prevent freezing thereof. In some arrangements, the collected water is mixed with supply water for flow to the fountain head the next time the fountain is turned on, as described in U.S. Pat. No. 4,282,895 and 4,520,836. Alternately, in another and more preferred design, the collected water is discharged to the main fountain drain the next time the fountain is turned on, as described in U.S. Pat. No. 5,553,637.

While these above-described freezeproof valve mechanisms function to permit fountain operation on a year-round basis, there still exists an ongoing need for further improvements, particularly with respect to eliminating undesirable failure modes. More specifically, in the freezeproof valve mechanism described in U.S. Pat. No. 5,553,637, water pressure within the underground water supply line is employed when the main valve is turned off to retract a spring-loaded piston within the collection chamber so that residual water in a fountain standpipe can drain to the collection chamber. When the main valve is turned on, the water pressure is substantially relieved from the piston which advances by spring action to expel the collected water through a discharge conduit to the fountain drain, followed by subsequent pressure responsive piston retraction when the main valve is again turned off to allow residual water within the standpipe and the discharge conduit to drain into the collection chamber. However, if the water supply pressure is interrupted for any reason, the piston will be spring-advanced prematurely and spring-retained in the advanced position, whereby the discharge conduit will be filled with water that is exposed to freezing temperature conditions.

The improved freezeproof valve assembly of the present invention overcomes these problems and disadvantages by providing an underground sump chamber with a piston movably mounted therein, wherein the piston has a normal unbiased retracted position to allow water to drain into the sump chamber when the main fountain valve is turned off, or when the water supply pressure is interrupted.

SUMMARY OF THE INVENTION

In accordance with the invention, an improved freezeproof valve assembly is provided for use in an outdoor water hydrant, particularly such as an outdoor drinking fountain or the like. The freezeproof valve assembly comprises a sump housing defining a sump chamber positioned in a frost-free location and coupled to the fountain for drain collection of residual water remaining water flow lines exposed to freezing temperatures, whenever a main fountain valve is turned off. Subsequently, when the main fountain valve is turned on, a piston mounted within the sump chamber is displaced by water pressure to expel the collected water through a discharge conduit to a main fountain drain.

In a preferred form, the fountain comprises a fountain bubbler head or the like mounted on a pedestal in a position to provide a gentle stream of water projected over a basin for convenient drinking access, with excess water being collected by the basin for flow through a main drain to a sewer line or the like. A valve actuator is mounted on the fountain typically at or near the fountain head for manual operation to open the main fountain valve located at a frost-free and typically underground position. The main valve couples a water supply conduit with a fountain standpipe to supply water to the fountain head.

The sump chamber is coupled via a drain line to the standpipe at a frost-free location typically slightly downstream from the main fountain valve. When the main valve is off, residual water within the standpipe is allowed to drain at low pressure through the drain line to the sump housing at the underside of the piston. The piston has a central flow port formed therein, preferably including a pressure responsive control valve adapted to open during low pressure conditions to permit the water to drain further through the piston flow port and into the sump chamber located at the upper side of the piston.

When the main fountain valve is subsequently turned on, water under pressure is coupled via the drain line to the underside of the piston, resulting in control valve closure and upward advancement of the piston to expel water previously collected within the sump chamber through the discharge conduit to the fountain drain. Thereafter, when the main valve is again turned off, residual water within the standpipe and also within the discharge conduit is allowed to drain back into the sump chamber where it is protected against freezing. In this regard, when the main valve is turned off, water pressure acting on the underside of the piston is relieved, and the piston retracts by gravity within the sump housing.

Other features and advantages of the present invention will become more apparent from the following detailed description, taken in conjunction with the accompanying drawings which illustrate, by way of example, the principles of the invention.

BRIEF DESCRIPTION OF THE INVENTION

The accompanying drawings illustrate the invention. In such drawings.

DETAILED DESCRIPTION OF THE PREFERRED EMBODIMENT

Figure 1:
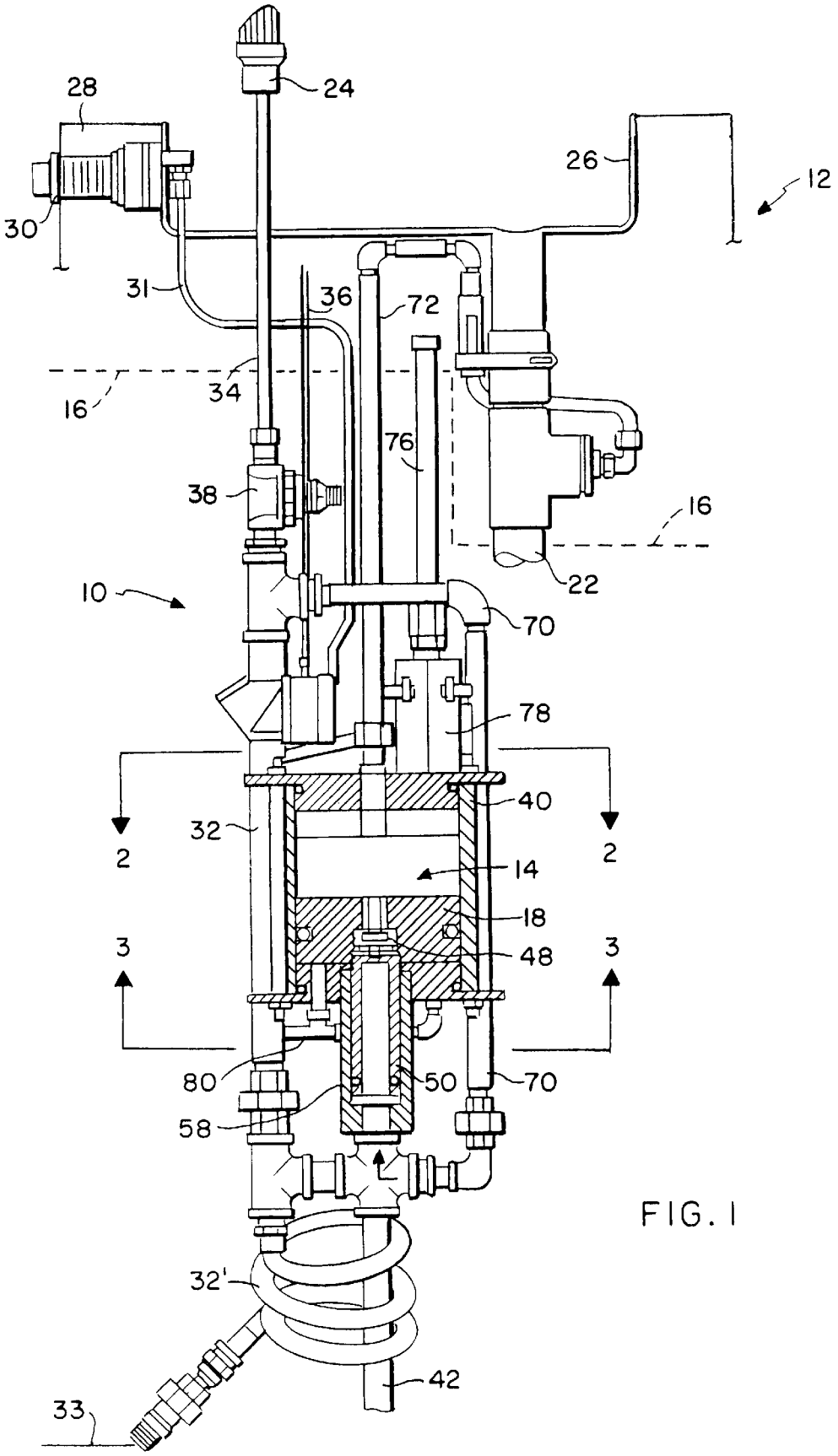
FIG. 1 is a fragmented side elevational view, shown in somewhat schematic form and partially in vertical section, depicting an improved freezeproof valve assembly constructed in accordance with the novel features of the invention and showing a main valve in an "off" condition.

As shown in the exemplary drawings, an improved freezeproof or freeze resistant valve assembly referred to generally by the reference numeral 10 is provided for use in an outdoor water hydrant, particularly such as an outdoor drinking fountain 12. The valve assembly 10 comprises a sump chamber 14 mounted at a frost-free location, such as at an underground position below a normal frost line indicated in FIG. 1 by the reference numeral 16. The sump chamber 14 has a piston 18 mounted therein to permit residual water remaining within fountain water lines above the frost line 16 to drain into and collect within the sump chamber 14 when a main fountain valve 20 is turned off. However, when the main fountain valve 20 is turned on, the piston is displaced by water pressure to expel the water collected within the sump chamber 14 to a main fountain drain 22.

The freezeproof valve assembly 10 of the present invention is designed for use in an outdoor drinking fountain 12 or the like, of the typically having a fountain bubbler or head 24 mounted on or adjacent a basin 26 which is supported at a selected height by a fountain pedestal 28. A valve actuator 30 such as a pushbutton pneumatic actuator is mounted on the pedestal at or near the head 24, and functions to open or turn on the otherwise normally closed main fountain valve 20. In this regard, as viewed in FIG. 1, the actuator 30 is exposed on the pedestal for easy manual access, but the main valve 20 is positioned at a frost-free and typically underground location. When the pushbutton actuator 30 is depressed, the main valve 20 is opened to permit flow of water from an underground water supply conduit 32 upwardly through a standpipe 34 to the bubbler or head 24 of the drinking fountain. The main valve 20 is shown of the type for pneumatic actuation, coupled to the actuator 30 by a control line 31 and including a vent line 36 which normally projects upwardly to a point within the volume of the fountain pedestal 28. In addition, a flow regulator 38 is normally provided for flow and pressure control at a location downstream from the main valve 20, to insure that a gentle water stream 25 (FIG. 6) conducive to drinking is projected upwardly over the basin 26. This projected water stream is collected by the basin for guided drainage through the main fountain drain 22 to a waste or sewer line (not shown) or the like.

Figure 6:
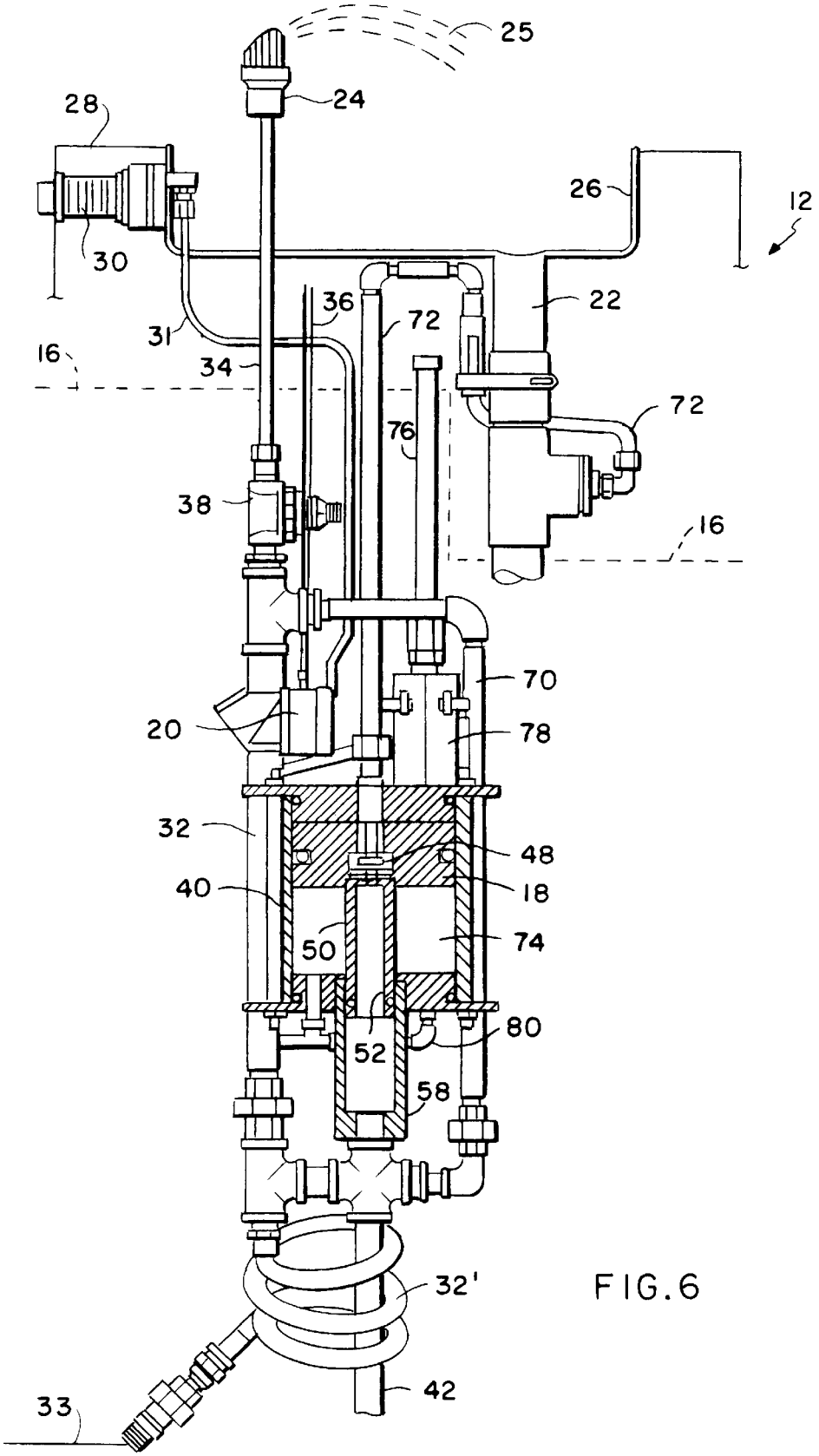
FIG. 6 is a fragmented side elevational view, similar to FIG. 1, but showing the main valve in an "on" condition.

In accordance with the invention, the freezeproof valve assembly 10 includes the sump chamber 14 defined within the hollow interior of an upright and generally cylindrical hollow sump housing 40, as shown in FIGS. 1 and 6, positioned at a location protected against freezing temperatures such as a location below the frost line 16. This sump housing 40 is mounted onto a rigid frame 42 which is conveniently carried by a rigid segment of the water supply conduit 32, shown to include a lower flexible hose segment 3' adapted for coupling to an underground water supply line 33. The piston 18 is movably carried within the sump housing 40 for vertical displacement with an upward advancing movement in response to water pressure when the main fountain valve 20 in turned on, and for downward retracting movement by gravity when the main valve 20 is turned off, as will be described in more detail. The interior volume of the sump housing 40 at the upper side of the piston 18 defines the sump chamber 14.

More specifically, with reference to FIGS. 1 and 4–6, the piston 18 carries an outer ring seal 44 for slidably and substantially sealingly engaging an inner wall 45 (FIGS. 4–5) of the sump housing 40. A central flow port 46 is formed in the piston 18 to permit water passage therethrough, and this flow port 46 is obstructed or restricted by a control member 48 shown in the exemplary drawings in the form of a pressure responsive flow control valve. In general, this control member 48 permits upward water flow through the piston flow port 46 at a slow rate and at a relatively low pressure. However, the control member 48 substantially restricts or obstructs and preferably prevents upward water flow through the piston flow port 46 at a fast flow rate or at a substantial pressure. The underside of the piston 18 carries a downwardly extending inlet sleeve 50 having an internal bore 52 communicating with the piston flow port 46, and an outer seal ring 54 slidably engaging the interior wall of a guide cylinder 58 (FIGS. 1 and 6) mounted at the bottom of the sump housing 40. This inlet sleeve 50 has a diametric size significantly smaller than the piston diameter.

Figure 5:
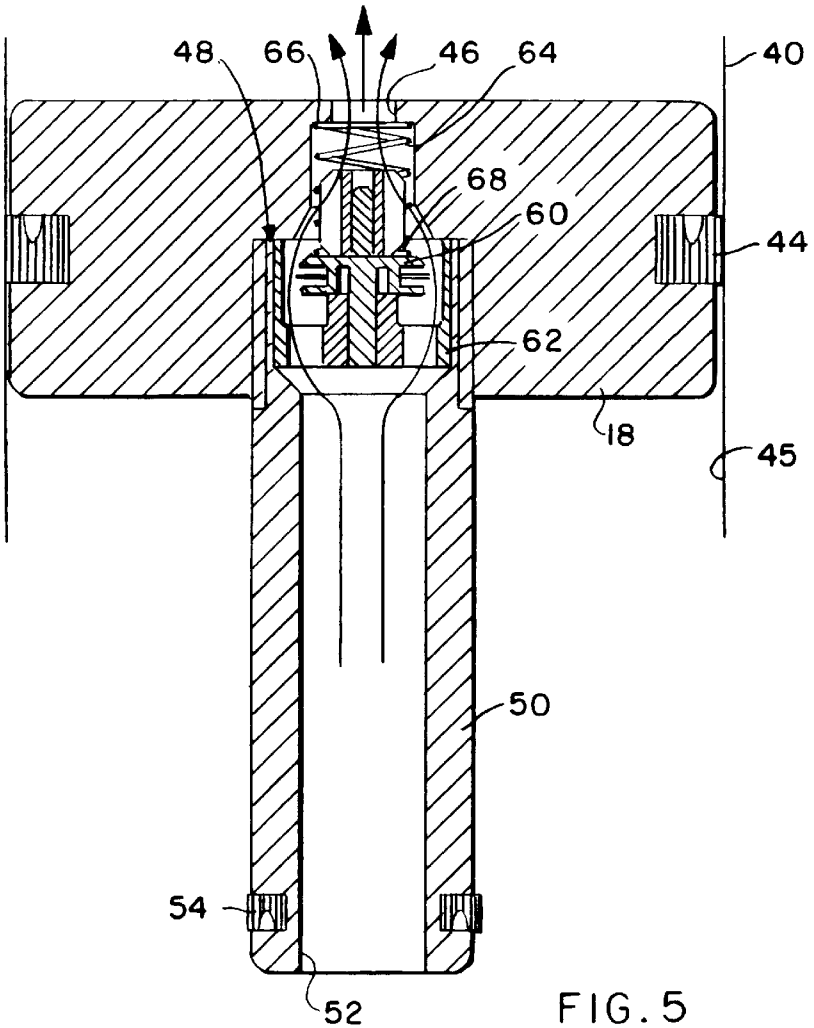
FIG. 5 is an enlarged vertical sectional view similar to FIG. 4, but depicting the pressure responsive control valve is a normally open position.
Figure 4:
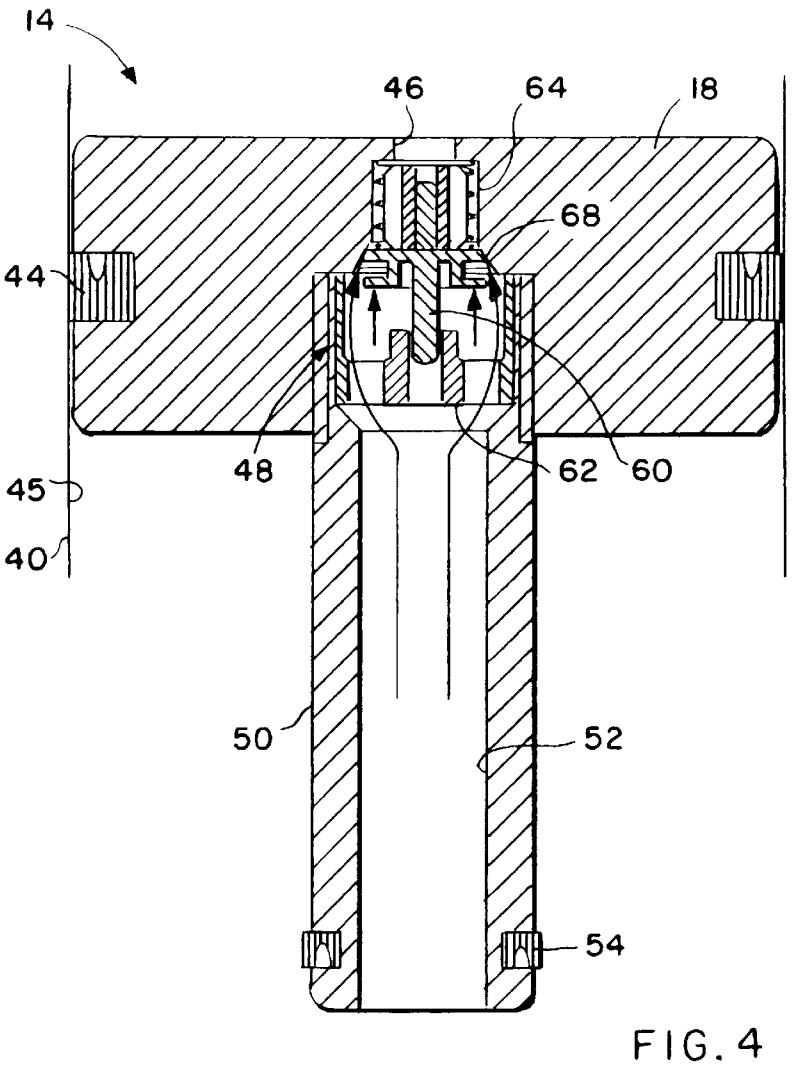
FIG. 4 is an enlarged vertical sectional view of a portion of the valve assembly as depicted in FIG. 1, illustrating a movable piston within a sump housing and having a pressure responsive control valve in a closed position.

The illustrative pressure responsive control valve 48 comprises a poppet head 60 carried by a support web 62 for sliding movement between an open position as viewed in FIG. 5, and a closed position as viewed in FIG. 4. A relatively light or low rate spring 64 reacts between a shoulder 66 lining the flow port 46 and the poppet head 60 for normally urging the head 60 to the open position relative to an annular seat 68 (FIG. 5). However, water pressure within the bore 52 of the inlet sleeve 50 acts upon on the poppet head 60 to carry the head 60 to a closed position (FIG. 4) resting upon the seat 68, to prevent water flow through the piston flow port 46.

In operation, when the main fountain valve 20 is opened or turned on as described above, the water supply is coupled through the standpipe 34 to the fountain head 24 to dispense water. At the same time, water under pressure is coupled to a drain line 70 having an upstream end tapped into the standpipe 34 preferably at a point upstream from the regulator 38. The drain line 70 connects the water under pressure to the lower end of the guide cylinder 58, and further to the bore 52 of the inlet sleeve 50 whereby the water pressure acts upon and closes the control valve 48. Accordingly, since the water under pressure cannot flow in any significant quantity through the piston flow port 46, the pressure causes the piston 18 to advance upwardly within the sump housing 40 as viewed in FIG. 6 to progressively decrease the available volume of the sump chamber 14. Any water residing within the sump chamber 14 is thus expelled by the piston 18 upwardly through the top of the sump housing 40 and further through a discharge conduit 72 to the main drain 22.

Figure 2:
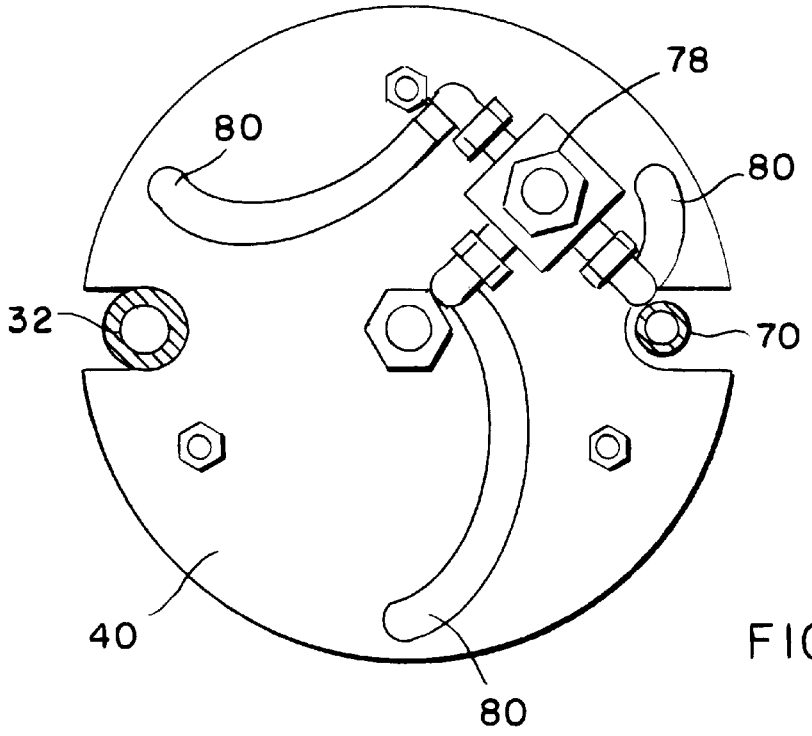
FIG. 2 is an enlarged horizontal sectional view taken generally on the line 2—2 of FIG. 1.
Figure 3:
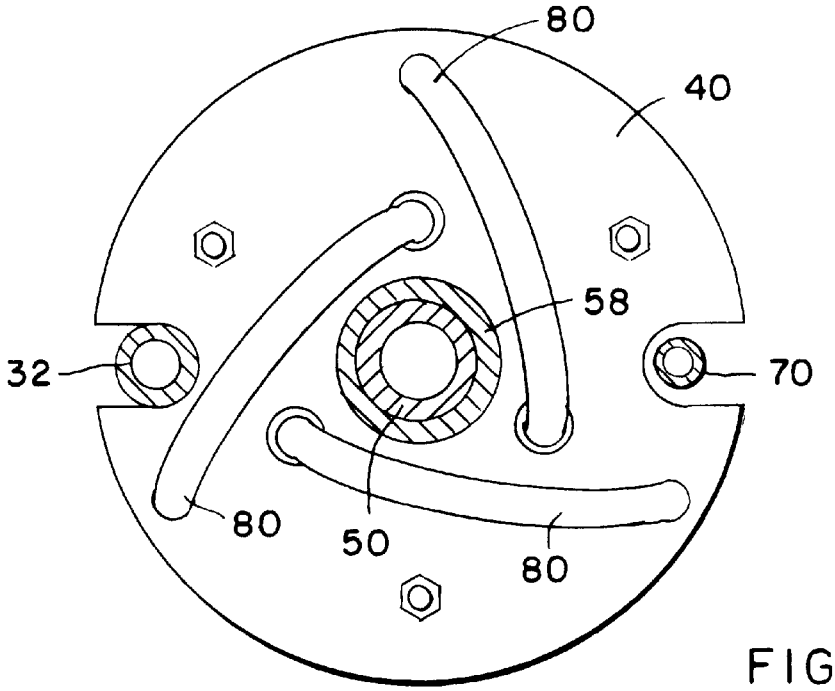
FIG. 3 is an enlarged horizontal sectional view taken generally on the line 3—3 of FIG. 1

When the main fountain valve 20 is closed or turned off, the pressure within the drain line 70 is relieved. When this occurs, the poppet head 60 of the control valve 48 is returned by the spring 64 to its normally open position as shown in FIG. 5. The residual water within the drain line 70 and also within the standpipe 34 can now drain easily and at low pressure into the inlet sleeve 50 and further through the piston flow port 46 into the sump chamber 14. At the same time, any residual water remaining within the discharge conduit 72 can also drain directly therefrom into the sump chamber 14. The sump chamber 14 progressively expands to accommodate and collect the draining water, as the piston 18 falls or retracts within the sump housing 40 by gravity action. Such retracting movement of the piston 18 is facilitated by forming a vented chamber 74 (FIG. 6) at the underside of the piston surrounding the guide cylinder 58. For this purpose, a main vent line 76 is shown (FIGS. 1 and 6) extending upwardly within the pedestal 28, with a lower end of the vent line 76 coupled through a manifold 78 (FIG. 2) and a plurality of vent hoses 80 (FIGS. 2 and 3) to the vented chamber 74 at the bottom of the sump housing. Importantly, with this construction, residual water within fountain flow lines extending above the frost line 16 is collected within the sump chamber 14 each time the main fountain valve 20 is turned off, independent of water pressure in the delivery system.

Subsequently, when the main valve 20 is again turned on, the water under pressure is recoupled through the drain line 70 to close the control valve 48 and translate the piston 18 upwardly within the sump housing 40 to expel previously collected water in the sump chamber 14 to the main drain 22, all as previously described.

The improved freezeproof valve assembly 10 of the present invention thus provides a relatively simple arrangement for collecting residual water in an underground sump chamber 14 where the collected water is protected against freezing. Each increment of collected water is expelled to the drain 22 upon subsequent operation of the main fountain valve 20 to dispense water. Interruption of water supply pressure, when the main fountain valve 20 is in the off condition, does not result in exposing any portion of the collected water to freezing temperatures.

A variety of further modifications and improvements in and to the freezeproof valve assembly of the present invention will be apparent to those persons skilled in the art. For example, such persons will recognize and understand that the spring-loaded control valve 48 shown and described herein may be substituted by a simple orifice means for allowing a relatively low pressure and slow flow rate of water therethrough while obstructing or restricting water flow at higher pressure so that the piston is translated upwardly when the main fountain valve is turned on. Accordingly, no limitation on the invention is intended by way of the foregoing description and accompanying drawings, except as set forth in the appended claims.

What is claimed is:

1. A freezeproof valve assembly for use in a drinking fountain having a standpipe, a fountain head mounted at an upper end of the standpipe, a main fountain valve mounted at a lower end of the standpipe and movable between open and closed positions for selectively coupling the standpipe to a water supply conduit; and a main drain for waste flow of water dispensed from the fountain head; said assembly comprising:

a sump housing having a hollow interior;

a piston mounted for vertical displacement within said sump housing, said piston and said sump housing cooperatively defining a sump chamber disposed at an upper side of said piston, said piston having a flow port formed therein for flow through passage of water from a lower side of said piston to said sump chamber;

a drain line adapted to be coupled between the standpipe and said sump housing for flow of water from said standpipe to the lower side of said piston;

a discharge conduit adapted to be coupled between said sump chamber and the main drain; and pressure responsive control means carried by said piston to permit water flow through said piston flow port at a relatively low flow rate and pressure, and to substantially prevent water flow through said piston flow port at a relatively high flow rate and pressure, whereby said pressure responsive control means permits water within the standpipe to drain through said drain line and further through said piston flow port for collection within said sump chamber when the main fountain valve is in the closed position, and whereby said pressure responsive control means obstructs water flow through said piston flow port sufficiently when the main fountain valve is in the open position so that water pressure displaces said piston upwardly within said sump housing to expel water collected within said sump chamber through said discharge conduit to the main drain.

2. The freezeproof valve assembly of claim 1 wherein the drinking fountain further includes actuator means for moving the main fountain valve between the open and closed positions.

3. The freezeproof valve assembly of claim 1 wherein the drinking fountain further includes flow regulator means mounted along the standpipe for regulating the flow rate and pressure of water supplied to the fountain head, said drain line adapted to be coupled between the standpipe at a location upstream from the flow regulator means and said sump housing.

4. The freezeproof valve assembly of claim 1 wherein said sump housing is mounted in a location protected against freezing temperatures.

5. The freezeproof valve assembly of claim 4 wherein said sump housing is mounted underground below the normal frost line.

6. The freezeproof valve assembly of claim 1 wherein said piston displaces downwardly by gravity within said sump housing when the main fountain valve is in the closed position.

7. The freezeproof valve assembly of claim 1 wherein said pressure responsive control means comprises a pressure responsive valve normally open to permit water flow through said piston flow port and responsive to water pressure at the lower side of said piston to close when the main fountain valve is in the open position.

8. The freezeproof valve assembly of claim 1 further including an inlet sleeve carried by said piston and extending downwardly therefrom, and a guide cylinder having said inlet sleeve slidably carried therein, said drain line adapted to be coupled between the standpipe and said guide cylinder, and said inlet sleeve defining an internal bore communicating with said piston flow port.

9. The freezeproof valve assembly of claim 8 wherein said inlet sleeve has a diametric size substantially less than the diametric size of said piston.

10. The freezeproof valve assembly of claim 9 wherein said sump housing further defines a vented chamber at a lower side of said piston surrounding said guide cylinder.

11. A drinking fountain, comprising:

a fountain head;

means for mounting said fountain head at a selected height above the ground;

a water standpipe having said fountain head mounted at an upper end thereof;

a main fountain valve mounted at a lower end of said standpipe and adapted to be located in a position protected against freezing temperatures, said main fountain valve being movable between open and closed positions for selectively coupling the standpipe to a water supply conduit for flow of water to and dispensing from said fountain head;

a main drain mounted for waste flow of water dispensed from the fountain head;

a sump housing having a hollow interior, said sump housing adapted to be located in a position protected against freezing temperatures;

a piston mounted for vertical displacement within said sump housing, said piston and said sump housing cooperatively defining a sump chamber disposed at an upper side of said piston, said piston having a flow port formed therein for flow through passage of water from a lower side of said piston to said sump chamber;

a drain line coupled between said standpipe and said sump housing for flow of water from said standpipe to the lower side of said piston;

a discharge conduit coupled between said sump chamber and said main drain; and pressure responsive control means carried by said piston to permit water flow through said piston flow port at a relatively low flow rate and pressure, and to substantially prevent water flow through said piston flow port at a relatively high flow rate and pressure, whereby said pressure responsive control means permits water within said standpipe to drain through said drain line and further through said piston flow port for collection within said sump chamber when said main fountain valve is in the closed position, and whereby said pressure responsive control means obstructs water flow through said piston flow port sufficiently when said main fountain valve is in the open position so that water pressure displaces said piston upwardly within said sump housing to expel water collected within said sump chamber through said discharge conduit to said main drain.

12. The drinking fountain of claim 11 further including actuator means for moving the main fountain valve between the open and closed positions.

13. The drinking fountain of claim 11 further including flow regulator means mounted along said standpipe for regulating the flow rate and pressure of water supplied to said fountain head, said drain line being coupled between said standpipe at a location upstream from the flow regulator means and said sump housing.

14. The drinking fountain of claim 11 wherein said main fountain valve and said sump housing are adapted to be located below a normal ground frost line.

15. The drinking fountain of claim 11 wherein said piston displaces downwardly by gravity within said sump housing when said main fountain valve is in the closed position.

16. The drinking fountain of claim 11 wherein said pressure responsive control means comprises a pressure responsive valve normally open to permit water flow through said piston flow port and responsive to water pressure at the lower side of said piston to close when said main fountain valve is in the open position.

17. The drinking fountain of claim 11 further including an inlet sleeve carried by said piston and extending downwardly therefrom, and a guide cylinder having said inlet sleeve slidably carried therein, said drain line being coupled between said standpipe and said guide cylinder, and said inlet sleeve defining an internal bore communicating with said piston flow port.

18. The drinking fountain of claim 17 wherein said inlet sleeve has a diametric size substantially less than the diametric size of said piston.

19. The drinking fountain of claim 18 wherein said sump housing further defines a vented chamber at a lower side of said piston surrounding said guide cylinder.

20. A freezeproof valve assembly for use in a drinking fountain having a standpipe, a fountain head mounted at an upper end of the standpipe, a main fountain valve mounted at a lower end of the standpipe and movable between open and closed positions for selectively coupling the standpipe to a water supply conduit, and a main drain for waste flow of water dispensed from the fountain head, said assembly comprising:

a sump housing having a hollow interior;

a piston mounted for vertical displacement within said sump housing, said piston and said sump housing cooperatively defining a sump chamber disposed at an upper side of said piston, said piston having a flow port formed therein for flow through passage of water from a lower side of said piston to said sump chamber;

a drain line adapted to be coupled between the standpipe and said sump housing for flow of water from said standpipe to the lower side of said piston;

a discharge conduit adapted to be coupled between said sump chamber and the main drain; and pressure responsive control means carried by said piston and including a pressure responsive valve normally open to permit water flow through said piston flow port at a relatively low flow rate and pressure, and responsive to water pressure to substantially prevent water flow through said piston flow port at a relatively high flow rate and pressure, whereby said pressure responsive control means permits water within the standpipe to drain through said drain line and further through said piston flow port for collection within said sump chamber when the main fountain valve is in the closed position, said piston displacing downwardly by gravity within said sump housing when the main fountain valve is in the closed position, and Whereby said pressure responsive control means obstructs water flow through said piston flow port sufficiently when the main fountain valve is in the open position so that water pressure displaces said piston upwardly within said sump housing to expel water collected within said sump chamber through said discharge conduit to the main drain.

* * * * *